US011041428B2

(12) United States Patent
Zhu et al.

(10) Patent No.: US 11,041,428 B2
(45) Date of Patent: Jun. 22, 2021

(54) METHOD AND APPARATUS FOR CONTROLLING WATER TEMPERATURE OF ENGINE

(71) Applicant: Guangzhou Automobile Group Co., Ltd., Guangdong (CN)

(72) Inventors: Liang Zhu, Guangdong (CN); Xin Li, Guangdong (CN); Zhongshan Li, Guangdong (CN); Yongcheng Zhu, Guangdong (CN); Zhixin Zeng, Guangdong (CN)

(73) Assignee: GUANGZHOU AUTOMOBILE GROUP CO., LTD., Guangdong (CN)

( * ) Notice: Subject to any disclaimer, the term of this patent is extended or adjusted under 35 U.S.C. 154(b) by 233 days.

(21) Appl. No.: 16/305,066

(22) PCT Filed: Jul. 21, 2017

(86) PCT No.: PCT/CN2017/093836
§ 371 (c)(1),
(2) Date: Nov. 28, 2018

(87) PCT Pub. No.: WO2018/019183
PCT Pub. Date: Feb. 1, 2018

(65) Prior Publication Data

US 2020/0370464 A1 Nov. 26, 2020

(30) Foreign Application Priority Data

Jul. 26, 2016 (CN) ..... 201610602266.2

(51) Int. Cl.
*F01P 7/16* (2006.01)

(52) U.S. Cl.
CPC ..... *F01P 7/167* (2013.01); *F01P 7/161* (2013.01); *F01P 7/164* (2013.01); *F01P 2025/32* (2013.01)

(58) Field of Classification Search
CPC .. F01P 7/167; F01P 7/164; F01P 7/161; F01P 2025/32
(Continued)

(56) References Cited

U.S. PATENT DOCUMENTS

2004/0035194 A1 2/2004 Wakahara
2004/0173012 A1 9/2004 Tsukamoto et al.
(Continued)

FOREIGN PATENT DOCUMENTS

CN 101710025 A 5/2010
CN 102418585 A 4/2012
(Continued)

OTHER PUBLICATIONS

International Search Report for PCT application No. PCT/CN2017/093836 filed on Jul. 21, 2017,dated Oct. 23, 2017.

*Primary Examiner* — Mahmoud Gimie
(74) *Attorney, Agent, or Firm* — Gang Yu

(57) ABSTRACT

Provided is a method for controlling a water temperature of an engine. The method includes: collecting outlet water temperatures of the engine at predetermined time intervals (S101); when a number of the collected outlet water temperatures of the engine is greater than or equal to a predetermined number, determining a water temperature variation function of the outlet water temperatures of the engine with time according to collected each outlet water temperature of the engine and collection time corresponding to the each outlet water temperature of the engine (S102); and determining performance parameters of a cooling system under the water temperature variation function, and controlling controllable parts of the cooling system according to the performance parameters of the cooling system (S103). Further provided is an apparatus for controlling the water temperature of the engine.

16 Claims, 6 Drawing Sheets

(58) Field of Classification Search
USPC ..... 123/41.12
See application file for complete search history.

(56) References Cited

U.S. PATENT DOCUMENTS

| | | | | |
|---|---|---|---|---|
| 2009/0126656 | A1* | 5/2009 | Mounetou | F01P 7/167 123/41.1 |
| 2017/0248067 | A1* | 8/2017 | Park | F01P 7/16 |
| 2018/0073421 | A1* | 3/2018 | Hutchins | G05D 23/134 |
| 2019/0353086 | A1* | 11/2019 | Byun | F02D 41/222 |

FOREIGN PATENT DOCUMENTS

| | | | |
|---|---|---|---|
| CN | 102979638 | A | 3/2013 |
| CN | 103557976 | A | 2/2014 |
| CN | 103573382 | A | 2/2014 |
| CN | 104379894 | A | 2/2015 |
| CN | 104533592 | A | 4/2015 |
| CN | 104696945 | A | 6/2015 |
| CN | 106089395 | A | 11/2016 |
| DE | 10014752 | B4 | 4/2013 |
| GB | 2501699 | A | 11/2013 |
| JP | 2011214566 | A | 10/2011 |
| JP | 4975153 | B2 | 7/2012 |
| SE | 526638 | C2 | 10/2005 |

* cited by examiner

METHOD AND APPARATUS FOR CONTROLLING WATER TEMPERATURE OF ENGINE

TECHNICAL FIELD

The present disclosure relates to the technical field of vehicle control, and more particularly, to a method for controlling a water temperature of an engine and an apparatus for controlling the water temperature of the engine.

BACKGROUND

Water temperature plays an important role in oil consumption and emission of an engine. A cooling system, as a main functional system of a vehicle for controlling the water temperature of the engine, implements direct adjustment on the water temperature of the engine via controllable parts. At present, a common control manner is to control the water temperature directly based on a current water temperature. For example, when the water temperature reaches to a certain upper limit or a certain lower limit, some level of some controllable part of the cooling system is started. However, the cooling system of the vehicle pertains to a "large lag" system. Based on such a water temperature control manner, the "over adjustment" or "under adjustment" is easily occurred so that the water temperature fluctuates back and forth.

SUMMARY

In view of this, the embodiments of the present disclosure are intended to provide a method for controlling a water temperature of an engine and an apparatus for controlling the water temperature of the engine, which may implement the accurate control on the water temperature of the engine and the quick stabilization on the water temperature.

To this end, the following technical solutions are adopted by the embodiments of the present disclosure.

A method for controlling a water temperature of an engine may include the following steps.

Outlet water temperatures of the engine are collected at predetermined time intervals.

When a number of the collected outlet water temperatures of the engine is greater than or equal to a predetermined number, a water temperature variation function of the outlet water temperatures of the engine with time is determined according to collected each outlet water temperature of the engine and collection time corresponding to the each outlet water temperature of the engine;

Performance parameters of a cooling system under the water temperature variation function are determined, and controllable parts of the cooling system are controlled according to the performance parameters of the cooling system.

An apparatus for controlling a water temperature of an engine may include a temperature collection module, a water temperature function determination module, a performance parameter determination module and a control module.

The temperature collection module is configured to collect outlet water temperatures, of the engine at predetermined time intervals.

The water temperature function determination module is configured to determine, when a number of the collected outlet water temperatures of the engine is greater than or equal to a predetermined number are collected, a water temperature variation function of the outlet water temperatures of the engine with time according to collected each outlet water temperature of the engine and collection time corresponding to the each outlet water temperature of the engine.

The performance parameter determination module is configured to determine performance parameters of a cooling system under the water temperature variation function.

The control module is configured to control controllable parts of the cooling system according to the performance parameters of the cooling system.

According to the above-mentioned solutions of the embodiments of the present disclosure, by collecting the outlet water temperatures of the engine, determining the water temperature variation function of the outlet water temperatures of the engine with the time based on the collected outlet water temperatures of the engine and the collection time, determining the performance parameters of the cooling system under the water temperature variation function and thus controlling the controllable parts of the cooling system, the parts of the cooling system may be controlled in advance, and the accurate control on the water temperature of the engine and the quick stabilization on the water temperature may be implemented.

DETAILED DESCRIPTION OF THE EMBODIMENTS

For making the purpose, technical solutions and advantages of the present disclosure clearer, the present disclosure will further be described below in combination with the drawings and embodiments in detail. It should be understood that the specific embodiments described here are adopted not to limit the present disclosure but only to explain the present disclosure.

Figure 1:
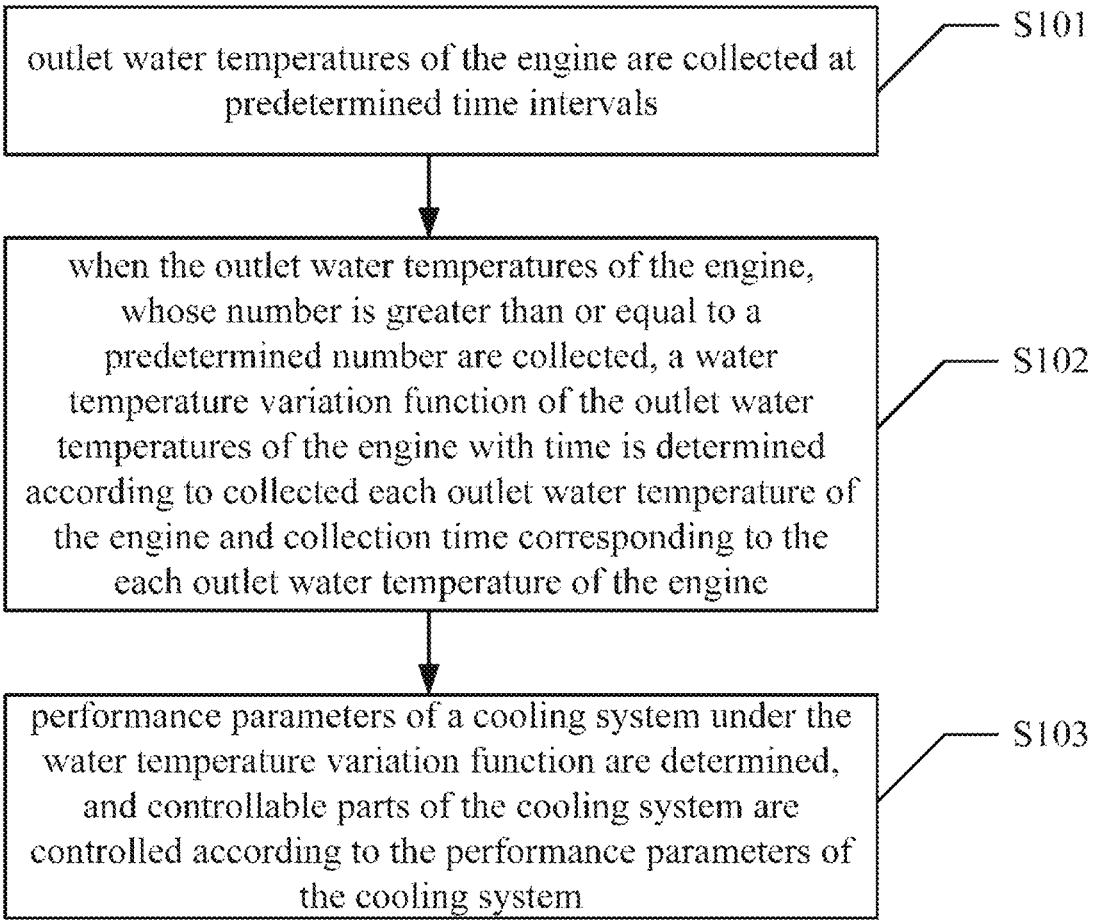
FIG. 1 is a flowchart schematic diagram of a method for controlling a water temperature of an engine in one embodiment.

FIG. 1 is a flowchart schematic diagram of a method for controlling a water temperature of an engine in one embodiment. As shown in FIG. 1, the method in this embodiment may include the following steps.

At S101: outlet water temperatures of the engine are collected at predetermined time intervals.

At S102: when the outlet water temperatures of the engine, whose number is greater than or equal to a predetermined number are collected, a water temperature variation function of the outlet water temperatures of the engine with time, is determined according to collected each outlet water temperature of the engine and collection time corresponding to the each outlet water temperature of the engine.

At S103: performance parameters of a cooling system under the water temperature variation function are determined, and controllable parts of the cooling system are controlled according to the performance parameters of the cooling system.

According to the above-mentioned solutions of this embodiment of the present disclosure, by collecting the outlet water temperatures of the engine, determining the water temperature variation function of the outlet water temperatures of the engine with the time based on the collected outlet water temperatures of the engine and the collection time, determining the performance parameters of the cooling system under the water temperature variation function and thus controlling the controllable parts of the cooling system, the parts of the cooling system may be controlled in advance, and the accurate control on the water temperature of the engine and the quick stabilization on the water temperature may be implemented.

Herein, under a condition in which the precision of the collected outlet water temperatures of the engine meets a requirement, after the water temperature variation function is determined in the step S102, the method may directly proceed to the step S103 to determine the performance parameters of the cooling system under the water temperature variation function determined in the step S102.

Considering that it is very possible to cause an error when the outlet water temperature of the engine are collected, thus, after the water temperature variation function is determined in the step S102, the performance parameters of the cooling system may further be determined under a condition in which the water temperature variation function meets a requirement.

Figure 2:
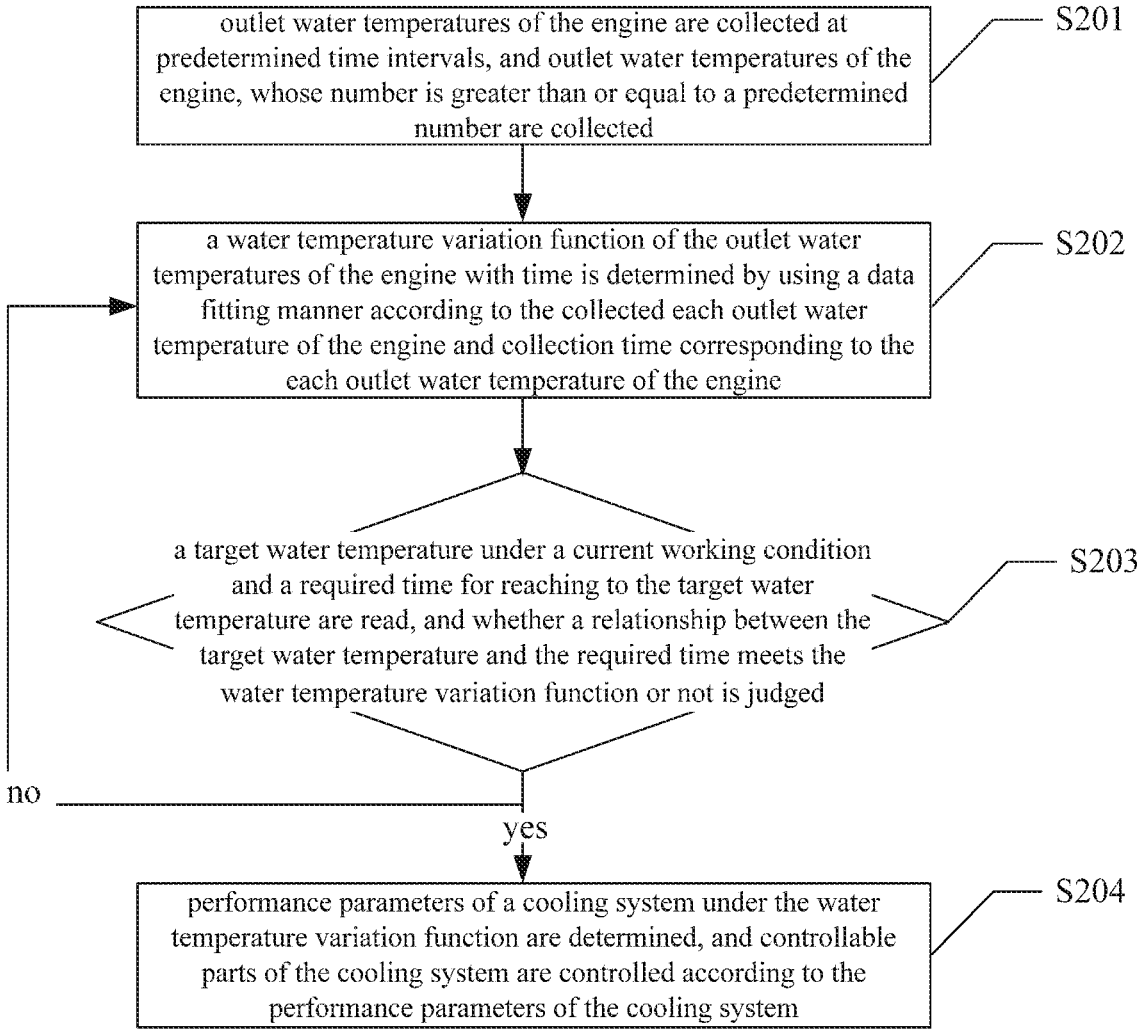
FIG. 2 is a flowchart schematic diagram of a method for controlling a water temperature of an engine in another embodiment.

Accordingly, FIG. 2 is a flowchart schematic diagram of a method for controlling a water temperature of an engine in another embodiment. On the basis of the embodiment shown in FIG. 1, this embodiment is described with the performance parameters of the cooling system being determined when the water temperature variation function meets the requirement as an example.

As shown in FIG. 2, the method for controlling the water temperature of the engine in this embodiment may include the following steps.

At S201: outlet water temperatures of the engine are collected at predetermined time intervals, and outlet water temperatures of the engine, whose number is greater than or equal to a predetermined number are collected.

At S202: a water temperature variation function of the outlet water temperatures of the engine with time is determined by using a data fitting manner according to the collected each outlet water temperature of the engine and collection time corresponding to the each outlet water temperature of the engine. Herein, the data fitting manner may be any possible manner, such as a least square method or an interpolation method. The specific data fitting manner is not limited in this embodiment of the present disclosure.

At S203: a target water temperature under a current working condition and a required time for reaching to the target water temperature are read, and whether a relationship between the target water temperature and the required time meets the water temperature variation function or not is judged; in a case where the relationship between the target water temperature and the required time does not meet the water temperature variation function, the step S202 is returned and a new water temperature variation function is determined by using the data fitting manner again; and in a case where the relationship between the target water temperature and the required time meets the water temperature variation function, the step S204 is proceeded to.

At S204: performance parameters of a cooling system under the water temperature variation function are determined, and controllable parts of the cooling system are controlled according to the performance parameters of the cooling system.

In the above two embodiments, the performance parameters of the cooling system may be set in combination with an actual demand. In one specific example, the performance parameters of the cooling system may include a heating power of the engine, a heat dissipation coefficient of the cooling system and a heat capacity of the cooling system. Correspondingly, the controllable parts of the cooling system may include a fan, a temperature regulator and a water pump.

Accordingly, when the controllable parts of the cooling system are controlled according to the performance parameters of the cooling system, a control manner in one specific example may include the followings.

Control signals for controlling the fan, the temperature regulator and the water pump are respectively output according to a heating power calibrated MAP diagram for calibrating the heating power of the engine, an inlet water temperature of a heat dissipation part of the engine, an outlet water temperature of the heat dissipation part of the engine and a water flow of the engine, a heat dissipation coefficient calibrated MAP diagram for calibrating the heat dissipation coefficient of the cooling system, a vehicle speed, a rotational speed of the fan and a rotational speed of the water pump, and a cooling system heat capacity calibrated MAP diagram for calibrating a corresponding relationship between a position of the temperature regulator and the heat capacity of the cooling system.

The heating power calibrated MAP diagram, the heat dissipation coefficient calibrated MAP diagram and the cooling system heat capacity calibrated MAP diagram may be obtained by calibrating the performance parameters of the cooling system before the outlet water temperatures of the engine are collected actually.

In a specific example, calibrating the heating power of the engine may be as follows.

The rotational speed of the fan, openness of the temperature regulator, a flow of the water pump and the heat capacity of the cooling system are kept unchanged and a rotational speed and an output torque of the engine are in a constant state; an inlet water temperature, an outlet water temperature and a water flow at a water side of the heat dissipation part are detected respectively under set each rotational speed of the engine and torque of the engine; a heat generation value corresponding to the each rotational speed of the engine and torque of the engine is determined according to an association relationship among the heating power of the engine, the inlet water temperature of the heat dissipation part, the outlet water temperature of the heat dissipation part, the water flow, a specific heat capacity of the water and a density of the water; and the heating power calibrated MAP diagram for calibrating the heating power of the engine, the inlet water temperature of the heat dissipation part, the outlet water temperature of the heat dissipation part and the water flow is formed according to the determined heat generation value as well as the corresponding inlet water temperature, outlet water temperature and water flow. It should be understood by those skilled in the art that, in a vehicle control technology, the MAP diagram is a data curve diagram obtained via a test and indicates a distributed situation for another parameter or another multiple parameters in a condition in which multiple variables (generally, two variables are provided) have different values. Herein, as a matter of fact, the heating power calibrated MAP diagram is a data curve diagram obtained based on the above test and characterizing the heating power of the engine, the inlet water temperature of the heat dissipation part, the outlet water temperature of the heat dissipation part and the water flow. It characterizes a distribution situation for the heating powers of the engine in a condition of different inlet water temperatures of the heat dissipation part and outlet water temperatures of the heat dissipation part under the above water flow.

Herein, in one specific application example, the association relationship among the heating power of the engine, the inlet water temperature of the heat dissipation part, the outlet water temperature of the heat dissipation part, the water flow, the specific heat capacity of the water and the density of the water may be as follows:

$$C=Q*\rho*C_p^1*(T_{in}-T_{out})$$

Wherein, the C is the heating power of the engine, the Q is the water flow, the ρ is the density of the water, the $C_p^1$ is the specific heat capacity of the water, the $T_{in}$ is the inlet water temperature of the heat dissipation part, and the $T_{out}$ is the outlet water temperature of the heat dissipation part.

In one specific example, calibrating the heat dissipation coefficient of the cooling system may be as follows: the heating power of the engine is kept unchanged, the speed of a vehicle in which the engine is located is kept unchanged and the temperature regulator is opened fully; under set each rotational speed of the water pump and rotational speed of the fan, the heat dissipation coefficient of the cooling system corresponding to the each rotational speed of the water pump and the rotational speed of the fan is determined according to a heat balance principle; and the rotational speed of the fan and the rotational speed of the water pump corresponding to each heat dissipation coefficient of the cooling system are determined based on a principle that the energy consumption of the water pump and the fan is minimum, to form the heat dissipation coefficient calibrated MAP diagram for calibrating the heat dissipation coefficient of the cooling system, the vehicle speed, the rotational speed of the fan and the rotational speed of the water pump. As mentioned above, the heat dissipation coefficient calibrated MAP diagram is a data curve diagram obtained based on the test and characterizing the heat dissipation coefficient of the cooling system, the vehicle speed, the rotational speed of the fan and the rotational speed of the water pump in fact. It characterizes a distributed situation for heat dissipation coefficients of the cooling system under a condition of different vehicle speeds, rotational speeds of the fan and rotational speeds of the water pump. Since four parameters are involved, a four-dimensional MAP diagram may be adopted in specific application.

Herein, in one specific application example, the heat balance principle may refer to that the change differences among system water temperatures within a predetermined time period are smaller than or equal to 1° C.; and determining the heat dissipation coefficient of the cooling system corresponding to each rotational speed of the water pump and rotational speed of the fan according to the heat balance principle may be as follows:

$$C=A(T_{water}-T_{air})$$

$$A=f(n_{fan},n_{pump},V)$$

Wherein, the C is the heating power of the engine, the A is the heat dissipation coefficient of the cooling system, the $T_{water}$ is the water temperature, the $T_{air}$ is an environmental temperature, the $n_{fan}$ is the rotational speed of the fan, the $n_{pump}$ is, the rotational speed of the water pump, and the V is the vehicle speed.

In a specific example, calibrating the heat capacity of the cooling system may be as follows: under a warming level, the temperature regulator is controlled to close a large circulation loop; in the process when the water temperature of the engine rises, the vehicle speed, the rotational speed of the water pump, the rotational speed of the fan and the heating power of the engine are kept unchanged; the heat capacity of the cooling system corresponding to each set position of the temperature regulator is measured based on a heat conservation relationship; under a cooling level, the temperature regulator is controlled to fully open the large circulation loop, and the vehicle speed, the rotational speed of the water pump, the rotational speed of the fan and the heating power of the engine are kept unchanged; the heat capacity of the cooling system corresponding to the each set position of the temperature regulator is measured based on the heat conservation relationship; and the cooling system heat capacity calibrated MAP diagram for calibrating the corresponding relationship between the position of the temperature regulator and the heat capacity of the cooling system is formed according to the heat capacity of the cooling system corresponding to the each set position of the temperature regulator under the warming level and the heat capacity of the cooling system corresponding to the each set position of the temperature regulator under the cooling level. As mentioned above, the cooling system heat capacity calibrated MAP diagram is a data curve diagram obtained based on the test and characterizing the heat capacity of the cooling system and the position of the temperature regulator. It characterizes a distributed situation for heat capacities of the cooling system at different positions of the temperature regulator.

Herein, in one specific application example, the heat conservation relationship may be as follows:

$$C=A(T_{water}-T_{air})+C_pT_{water}$$

Wherein, the C is the heating power of the engine, the A is the heat dissipation coefficient of the cooling system, the $T_{water}$ is the water temperature, the $T_{air}$ is the environmental temperature, and the $C_p$ is the heat capacity of the cooling system.

Based on the above solutions in each embodiment, the present disclosure will be described below in detail with reference to one specific application example therein. It may be understood by those skilled in the art that the detailed description of the specific application example is not intended to limit the solutions in the embodiments of the present disclosure.

Figure 3:
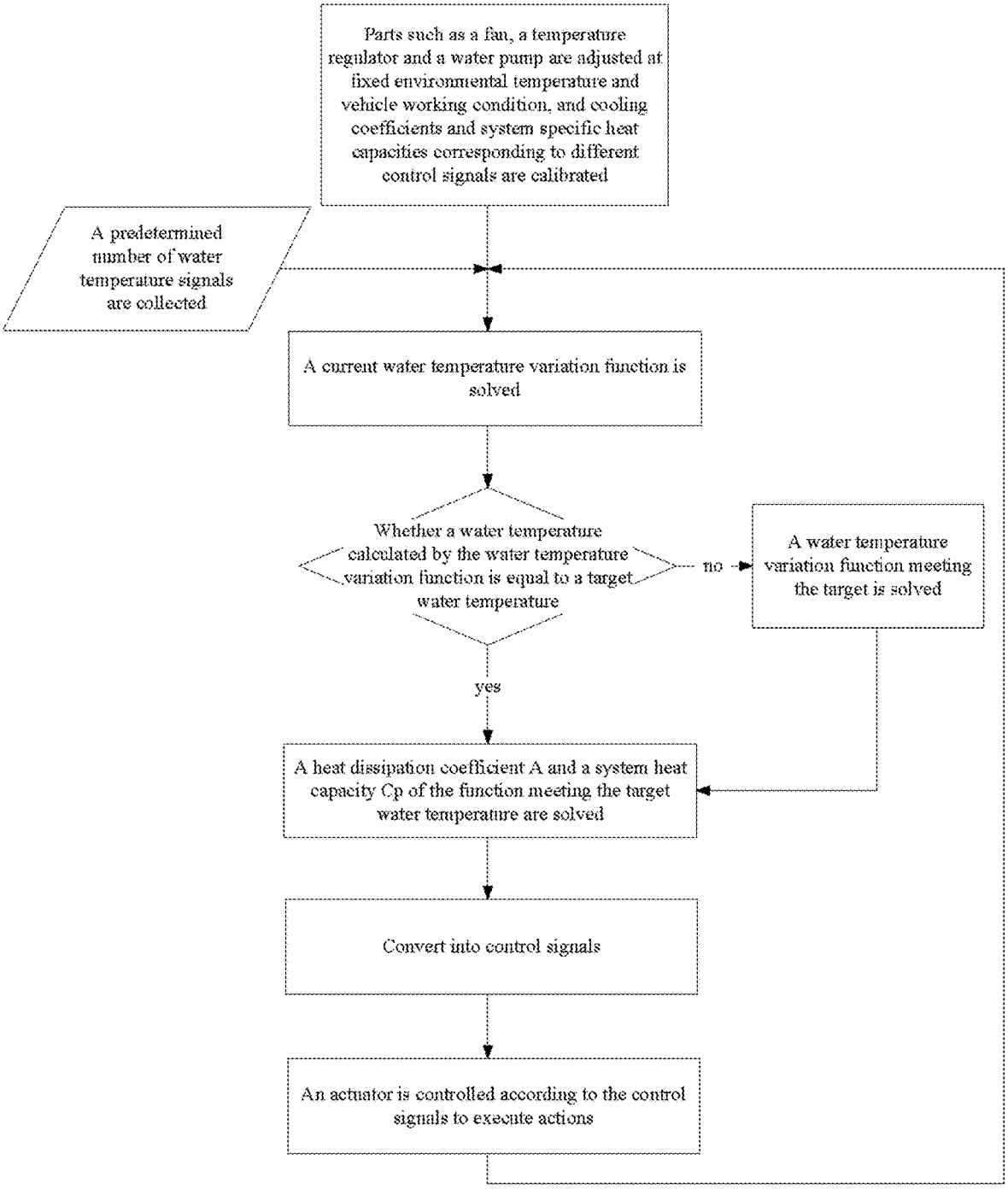
FIG. 3 is a flowchart schematic diagram of a method for controlling a water temperature of an engine in a specific example.

A flowchart schematic diagram of a method for controlling a water temperature of an engine in a specific example may be as shown in FIG. 3. As mentioned above, the performance parameters of the cooling system needs to be calibrated first. The performance parameters of the cooling system in needing of being calibrated may include: the rotational speed of the fan, the openness of the temperature regulator, the flow of the water pump, the heat capacity of the cooling system and the heating power of the engine. When the calibration is performed, a simple variable method may be adopted.

When the heating power C of the engine is calibrated, it may be appropriate to keep the rotational speed of the fan, the openness of the temperature regulator, the flow of the water pump and the heat capacity of the cooling system unchanged (fixed), guarantee that the rotational speed and the output torque of the engine are in the constant state (the rotational speed and the output torque of the engine may be guaranteed to be in the constant state by employing a common engine performance test rack); the inlet water temperature and the outlet water temperature at the water side (with a water-cooling engine as an example) of the heat dissipation part (mainly a radiator) as well as the water flow are detected respectively; the heat generation value corresponding to the each rotational speed and torque of the engine is determined according to the association relationship among the heating power of the engine, the inlet water temperature of the heat dissipation part, the outlet water temperature of the heat dissipation part, the water flow, the specific heat capacity of the water and the density of the water given in a following formula (1), that is, each rotational speed and torque of the engine are tested to obtain a value for the heating power C of the engine and thus the heating power calibrated MAP diagram for calibrating the heating power of the engine, the inlet water temperature of the heat dissipation part, the outlet water temperature of the heat, dissipation part, and the water flow is obtained. Herein, when each rotational speed and torque of the engine are set, it may be set in combination with an actual demand. For example, the rotational speeds of the engine may be set at intervals at 500 rpm and the torques of the engine may be set at intervals at 10%.

$$C=Q*\rho*C_p^{1}*(T_{in}-T_{out}) \quad (1)$$

Wherein, the C is the heating power of the engine, the Q is the water flow, the ρ is the density of the water, the $C_p^1$ is the specific heat capacity of the water, the $T_{in}$ is the inlet water temperature of the heat, dissipation part, and the $T_{out}$ is the outlet water temperature of the heat dissipation part.

When the heat dissipation coefficient A of the cooling system is calibrated, it may be appropriate to keep the heating power of the engine unchanged (fixed), keep the speed of the vehicle in which the engine is located unchanged (fixed) and keep the temperature regulator fully open. Under the set each rotational speed of the water pump and rotational speed of the fan, the heat dissipation coefficient of the cooling system corresponding to the each rotational speed of the water pump and rotational speed of the fan is determined according to the heat balance principle, that is, the rotational speed of the water pump and the rotational speed of the fan are respectively taken as variables, and according to the heat balance principle (the change differences among system water temperatures within a predetermined time period are smaller than or equal to 1° C., for example, the changes of the system water temperatures within 10 min are not greater than +1° C. and not smaller than −1° C.), system heat dissipation coefficients A corresponding to different rotational speeds of the water pump and rotational speeds of the fan are obtained and are specifically as shown in a following formula (2). Then, based on the principle that the energy consumption of the water pump and the fan are minimum, $n_{fan}$ and $n_{pump}$ required by different system heat exchange performances may be determined. The function in a form of f( ) may be directly described via the four-dimensional MAP diagram, and independent variables respectively are the vehicle speed, the $n_{fan}$ and the $n_{pump}$.

$$C=A(T_{water}-T_{air}) \text{ wherein } A=f(n_{fan},n_{pump},V) \quad (2)$$

Wherein, the C is the heating power of the engine, the A is the heat dissipation coefficient of the cooling system, the $T_{water}$ is the water temperature, the $T_{air}$ is the environmental temperature, the $n_{fan}$ is the rotational speed of the fan, the $n_{pump}$ is the rotational speed of the water pump, and the V is the vehicle speed.

When the heat capacity of the cooling system is calibrated, based on an energy balance method, in the process when the water temperature of the engine rises and on the basis of a system heat conservation relationship of a following formula (3), the heating power of the engine, the vehicle speed, the rotational speed of the water pump and the rotational speed of the fan are kept fixed, and the heat capacities of the cooling system corresponding to different positions of the temperature regulator are measured. The temperature regulator is generally provided with two levels, namely, a warming level and a cooling level. At the warming level, the temperature regulator closes the large circulation loop to implement quick warming. At the cooling level, the temperature regulator opens the large circulation loop fully to improve the large circulation flow as much as possible. The two levels need to be calibrated respectively.

Accordingly, since the temperature regulator is provided with the warming level and the cooling level and the two levels need to be calibrated respectively, when the heat capacity of the cooling system is calibrated, the specific implementation may be as follows.

At the warming level, the temperature regulator is controlled to close the large circulation loop; in the process when the water temperature of the engine rises, the vehicle speed, the rotational speed of the water pump, the rotational speed of the fan and the heating power of the engine are kept unchanged; and based on the heat conservation relationship, the heat capacity of the cooling system corresponding to each set position of the temperature regulator is measured.

At the cooling level, the temperature regulator is controlled to open the large circulation loop fully, and the vehicle speed, the rotational speed of the water pump, the rotational speed of the fan and the heating power of the engine are kept unchanged; and based on the heat conservation relationship, the heat capacity of the cooling system corresponding to each set position of the temperature regulator is measured.

The cooling system heat capacity calibrated MAP diagram for calibrating the corresponding relationship between the position of the temperature regulator and the heat capacity of the cooling system is formed according to the heat capacity of the cooling system corresponding to the each set position of the temperature regulator under the warming level and the heat capacity of the cooling system corresponding to the each set position of the temperature regulator under the cooling level.

$$C=A(T_{water}-T_{air})+C_pT_{water} \quad (3)$$

Wherein, the C is the heating power of the engine, the A is the heat dissipation coefficient of the cooling system, the $T_{water}$ is the water temperature, the $T_{air}$ is the environmental temperature, and the $C_p$ is the heat capacity of the cooling system.

Herein, the process for calibrating the performance parameters of the cooling system may be performed in advance. For example, the performance parameters of the cooling system can be calibrated in a performance test process before delivery. The obtained heating power calibrated MAP diagram, heat dissipation coefficient calibrated MAP diagram, cooling system heat capacity calibrated MAP diagram and the like may be configured in the engine or the vehicle where the engine is located so as to use the performance parameters of the cooling system in an actual engine working process.

In an actual working process of the engine, outlet water temperature of the engine is collected once every a section of predetermined time intervals, the predetermined time intervals may be set in combination with an actual demand and the outlet water temperatures of the engine whose number is greater than or equal to a predetermined number are collected. The predetermined number may be set in combination with an actual demand. In one specific example, the predetermined number may be 30.

Then, a water temperature variation function of the outlet water temperatures of the engine with time according to collected each outlet water temperature of the engine and collection time corresponding to the each outlet water temperature of the engine is determined. Specifically, the water temperature variation function T=f(t) of the current outlet water temperature T of the engine with the time t may be solved by employing a following formula (4).

$$T = C_1\left(e^{-\frac{A}{c_p}t} + C\right) \Big/ A + T_{amt} \tag{4}$$

Wherein, the T is the water temperature; the $C_1$ is the initial variable, in which when $C_1<0$, it is indicated that a water temperature rising process is described and when $C_1>0$ it is indicated that a water temperature reduction process is described; the $c_p$ is the heat capacity of the cooling system, the t is the time, the C is the heating power of the engine, the A is the system heat dissipation coefficient, and the $T_{amt}$ is the environmental temperature.

Based on the formula (4), the water temperature variation function T=f(t) may be solved. Referring to the above formula (4), the environmental temperature $T_{amt}$ may be detected by an environmental temperature sensor of the vehicle. Therefore, the formula (4) includes four variables, namely $C_1$, A, $C_p$ and C.

An equation including four variables is solved theoretically by using four or more dependent variable T values. Therefore, under a condition in which the precision of the collected outlet water temperatures of the engine meets the requirement, the water temperature variation function may be determined based on four outlet water temperatures, of the engine collected in a latest time.

As the frequency for collecting the water temperature of an engine control system of the vehicle is relatively high in general (the frequency may be up to 10 Hz), in order to solve the water temperature variation function more accurately, after the outlet water temperatures of the engine greater than or equal to the predetermined number (generally, there are not smaller than 30 the collection data) are collected, the water temperature variation function of the outlet water temperatures of the engine with the time is determined by using the data fitting manner according to the collected each outlet water temperature of the engine and the collection time corresponding to the each outlet water temperature of the engine. Herein, the data fitting manner may be any possible manner, such as a least square method or an interpolation method. The specific data fitting manner is not limited in this embodiment of the present disclosure.

After the water temperature variation function T=f(t) is obtained by the data fitting manner, a target water temperature T' under a current working condition and a required time t' for reaching to the target water temperature T' are read from the system, whether a relationship between the target water temperature T' and the required time t' meets the water temperature variation function T=f(t) or not is judged, and by substituting the target water temperature T' and the required time t' into the water temperature variation function T=f(t), whether the relationship between the target water temperature T' and the required time t' meets the water temperature variation function T'=f(t') or not is judged. That is, by substituting the required time t' into the water temperature variation function T=f(t), whether a obtained f(t') is equal to the target water temperature T' or not is judged, or a difference value between the obtained f(t') and the target water temperature T' is within an acceptable error range or not is judged; and in a case where the obtained f(t') is equal to the target water temperature T' or the difference value is within the acceptable error range, it may be judged that the relationship between the target water temperature T' and the required time t' meets the water temperature variation function T=f(t), or otherwise, the relationship between the target water temperature T' and the required time t' does not meet the water temperature variation function T=f(t).

In a case where the relationship between the target water temperature T' and the required time t' does not meet T'=T(t'), that is, the relationship between the target water temperature and the required time does not meet the water temperature variation function, the above solving process is returned and a new water temperature variation function T=f(t) is solved by using the data fitting manner again.

In a case where the relationship between the target water temperature T' and the required time t' meets T'=T(t'), that is, the relationship between the target water temperature and the required time meets the water temperature variation function, subsequent processing may be performed based on the current solved water temperature variation function according to an existing, state.

Based on the current solved water temperature variation function, the performance parameters of the cooling system under the water temperature variation function may be determined by using the following formulas (5) and (6), including the heating power of the engine, the heat dissipation coefficient of the cooling system, the heat capacity of the cooling system and other constant items.

$$T(0) = C_1\left(e^{-\frac{A}{c_p}t(0)} + C\right) \Big/ A + T_{amt} \tag{5}$$

$$T' - T(0) = C_1\left(e^{-\frac{A'}{C_p'}(t'-t(0))} + C\right) \Big/ A' + T_{amt} \tag{6}$$

Wherein, the t(0) is time from the system completes the data collection to the system hardware responds completed.

Based on the determined performance parameters of the cooling system under the water temperature variation function and in combination with the above heating power calibrated MAP diagram, the heat dissipation coefficient calibrated MAP diagram, and the cooling system heat capacity calibrated MAP diagram, control signals (such as a PWM duty ratio signal, a pulse number for a servo motor and the like) for controlling the fan, the temperature regulator and the water pump may be determined and output and thus the above required heating power C of the engine, the heat dissipation coefficient A of the cooling system, the heat capacity $C_p$ of the cooling system and the like are implemented.

Figure 4:
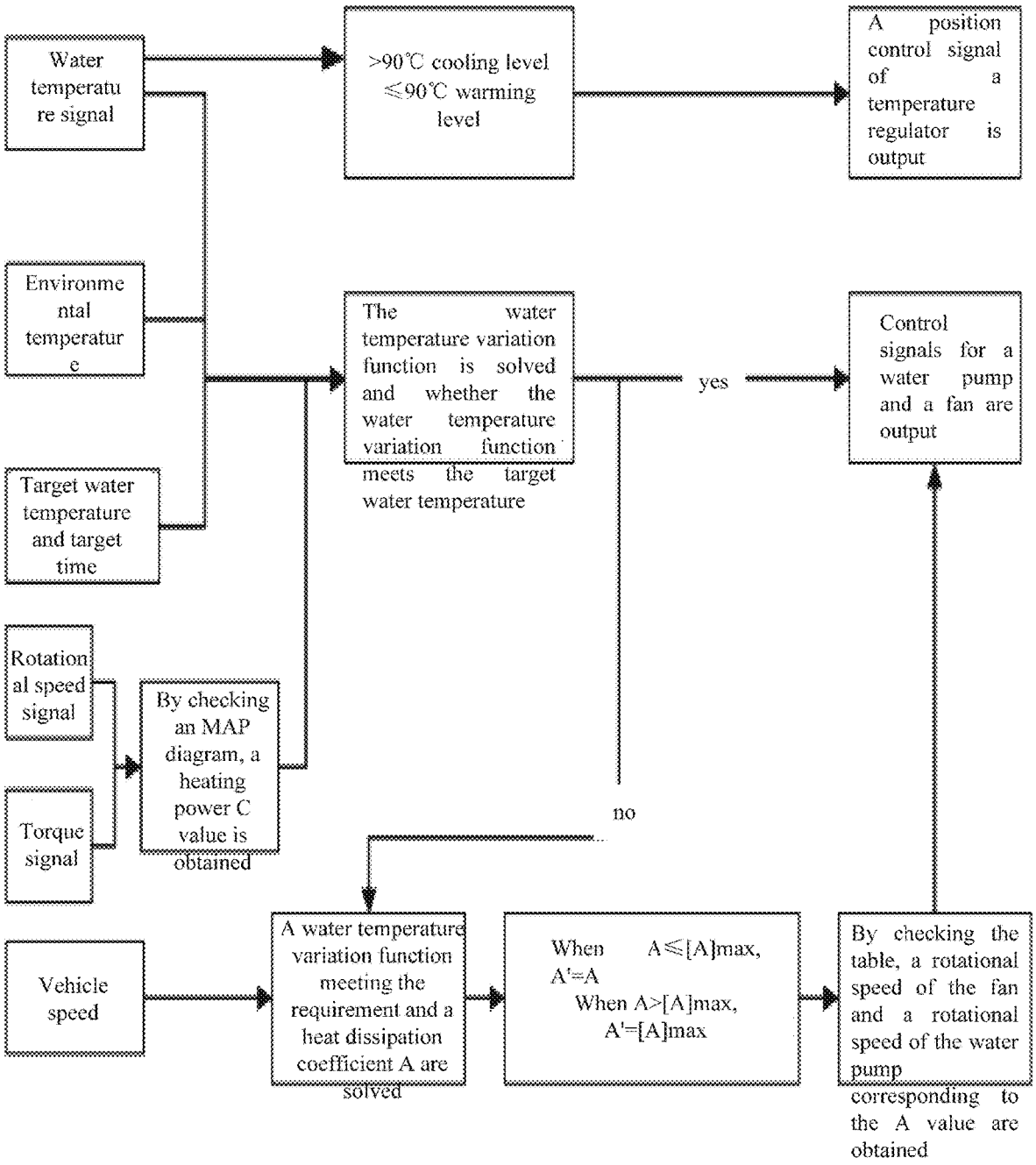
FIG. 4 is a principle logical schematic diagram of a method for controlling a water temperature of an engine in a specific example.

Accordingly, a principle logical schematic diagram of the method for controlling the water temperature of the engine in the above specific example may be as shown in FIG. 4. After a water temperature signal is collected, based on a state whether the temperature regulator is in the cooling level, greater than 90° C. or in the warming level smaller than or equal to 90° C., a control signal for the position of the temperature regulator may be output.

After a rotational speed signal on the rotational speed of the fan and the rotational speed of the water pump and a torque signal of the engine are collected and based on at least one of the above calibrated MAP diagrams, the heating power C value of the engine may be obtained. And meanwhile, in combination with the collected water temperature signal and environmental temperature, the water temperature variation function is solved; and in combination with the target water temperature and the target time, whether the target water temperature and the target time are met or not may be determined.

In a case where the target water temperature and the target time are met, control signals for the water pump and the fan may be determined based on the current water temperature variation function and are output.

In a case where the target water temperature and the target time are not, met, a water temperature variation function meeting the requirement and a heat dissipation coefficient A meeting the requirement are solved in combination with the speed of the current vehicle; when the solved heat dissipation coefficient A meeting the requirement is smaller than or equal to a maximum threshold value [A]max of the heat dissipation coefficient, the solved heat dissipation coefficient is taken as a determined heat dissipation coefficient A'; when the solved heat dissipation coefficient A meeting the requirement is greater than the maximum threshold value [A]max of the heat dissipation coefficient, the maximum threshold value [A]max of the heat dissipation coefficient is taken as the determined heat dissipation coefficient A'; and based on the determined heat dissipation coefficient A' and in combination with the heating power calibrated MAP diagram, the heat dissipation coefficient calibrated MAP diagram, and the cooling system heat capacity calibrated MAP diagram, control signals for the water pump and the fan are determined and are output.

Figure 5:
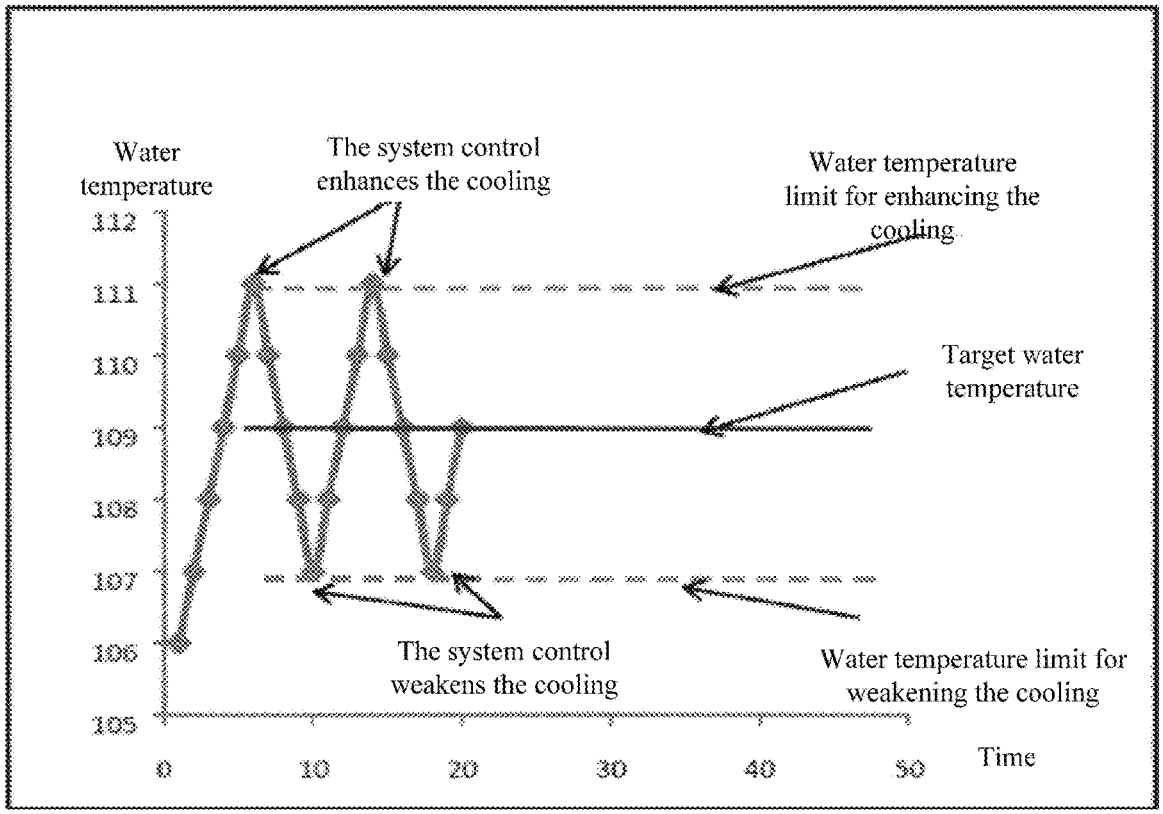
FIG. 5 is a schematic diagram of a water temperature control curve using a conventional technology.
Figure 6:
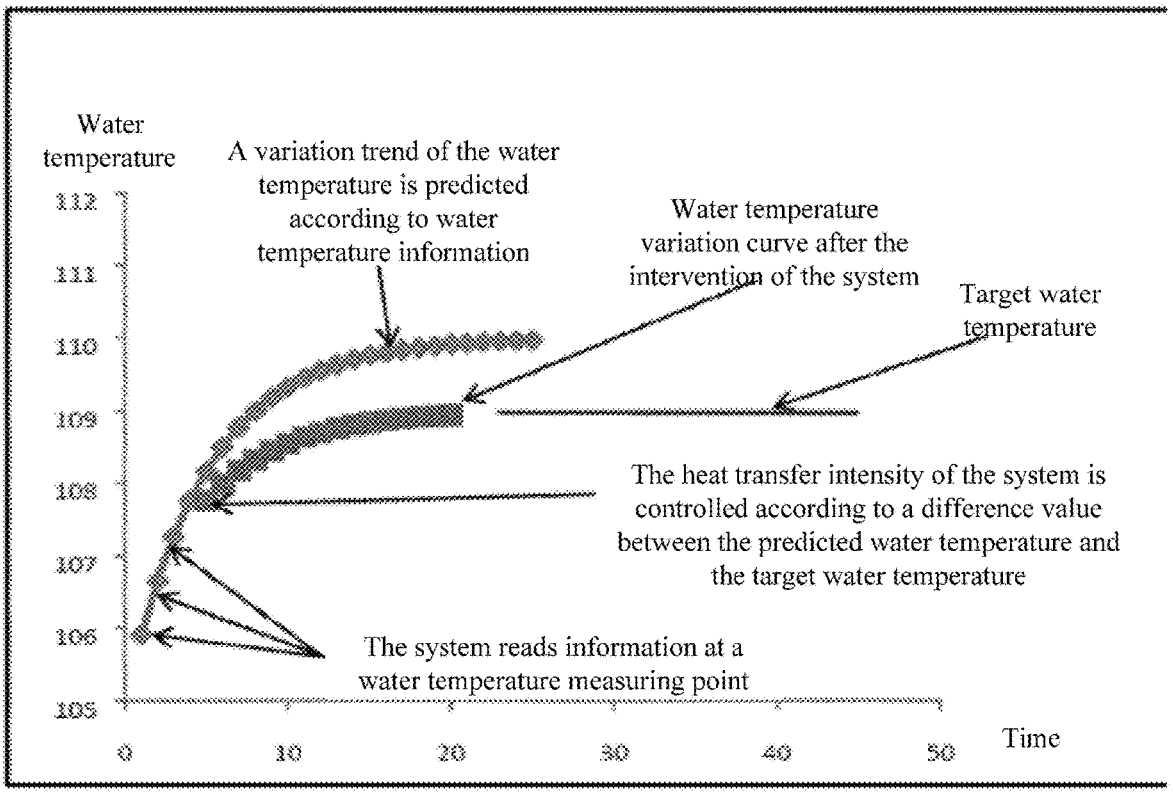
FIG. 6 is a schematic diagram of a water temperature variation curve based on a method of an embodiment of the present disclosure.

Based on the description of the specific example, FIG. 5 is a schematic diagram of a water temperature control curve using a conventional technology and FIG. 6 is a schematic diagram of a water temperature variation curve based on a method of an embodiment of the present disclosure. By comparing the FIG. 5 with FIG. 6, it may be seen that the water temperature variation curve of the conventional method fluctuates up and down within a certain range around the target water temperature and the target water temperature cannot be implemented completely. Moreover, the system continuously adjusts the adjustable part and will have an impact on the part and the vehicle. However, the method in the embodiments of the present disclosure calculates a required water temperature change tendency by collecting the water temperature signal and solves the specific control parameters, so the system meets the requirement on the best water temperature quickly and accurately.

Figure 7:
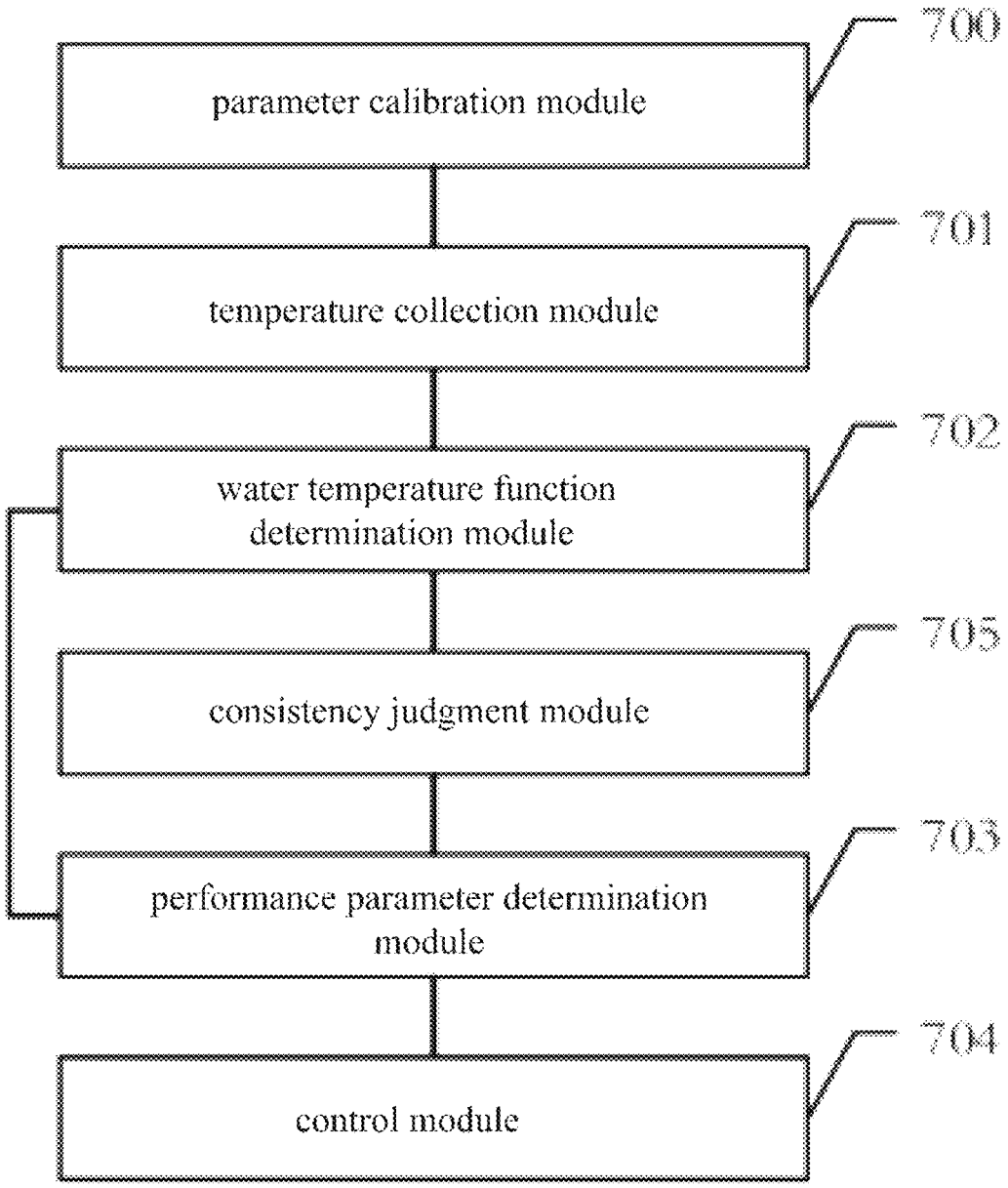
FIG. 7 is a structural schematic diagram of an apparatus for controlling a water temperature of an engine in one embodiment.

Based on a concept same as the above method, an embodiment of the present disclosure further provides an apparatus for controlling a water temperature of an engine. FIG. 7 is a structural schematic diagram of an apparatus for controlling a water temperature of an engine in one embodiment.

As shown in FIG. 7, the apparatus for controlling the water temperature of the engine may include a temperature collection module 701, a water temperature function determination module 702, a performance parameter determination module 703 and a control module 704.

The temperature collection module 701 is configured to collect outlet water temperatures of the engine at predetermined time intervals.

The water temperature function determination module 702 is configured to determine, when a number of the collected outlet water temperatures of the engine is greater than or equal to a predetermined number are collected, a water temperature variation function of the outlet water temperatures of the engine with time according to collected each outlet water temperature of the engine and collection time corresponding to the each outlet water temperature of the engine.

The performance parameter determination module 703 is configured to determine performance parameters of a cooling system under the water temperature variation function.

The control module 704 is configured to control controllable parts of the cooling system according to the performance parameters of the cooling system.

According to the above-mentioned solutions of this embodiment of the present disclosure, by collecting the outlet water temperatures of the engine, determining the water temperature variation function of the outlet water temperatures of the engine with the time based on the collected outlet water temperatures of the engine and the collection time, determining the performance parameters of the cooling, system under the water temperature variation function and thus controlling, the controllable parts of the cooling system, the parts of the cooling system may be controlled in advance, and the accurate control on the water temperature of the engine and the quick stabilization on the water temperature may be implemented.

In a specific example, the temperature collection module 701 further collects an environmental temperature.

At this moment, the water temperature function determination module 702 may determine the water temperature variation function according to the collected each outlet water temperature of the engine, the collection time corresponding to the each outlet water temperature of the engine and the environmental temperature.

Herein, under a condition in which the precision of the collected outlet water temperatures of the engine meets the requirement, according to the water temperature variation function determined by the water temperature function determination module 702, the performance parameters of the cooling system under the water temperature variation function may be directly determined by the performance parameter determination module 703.

Considering that it is very possible to cause an error when the outlet water temperature of the engine are collected, after the water temperature function determination module 702 determines the water temperature variation function, the performance parameters of the cooling system may be then determined under a condition in which the water temperature variation function meets the requirement.

Accordingly, as shown in FIG. 7, the apparatus in this embodiment may further include a consistency judgment module 705.

Herein, the consistency judgment module 705 is configured to read a target water temperature under a current working condition and a required time for reaching to the target water temperature, and judge whether a relationship between the target water temperature and the required time meets the water temperature variation function or not.

At this moment, the water temperature function determination module 702 determines the water temperature variation function by performing data fitting, on the collected each outlet water temperature of the engine and the collection time corresponding to the each outlet water temperature of the engine, and when a judgment result of the consistency judgment module 705 is no, determine the water temperature variation function by using the manner for the performing data fitting on the collected each outlet water temperature of the engine and the collection time corresponding to the each outlet water temperature of the engine again.

The performance parameter determination module 703 determines the performance parameters of the cooling system under the water temperature variation function when the judgment result of the consistency judgment module 705 is yes.

The performance parameters of the cooling system may be set in combination with an actual demand. In one specific example, the performance parameters of the cooling system may include a heating power of the engine, a heat dissipation coefficient of the cooling system and a heat capacity of the cooling system. Correspondingly, the controllable parts of the cooling system may include a fan, a temperature regulator and a water pump.

Correspondingly, the control module 704 respectively outputs control signals for controlling the fan, the temperature regulator and the water pump according to a heating power calibrated MAP diagram for calibrating the heating power of the engine, an inlet water temperature of a heat dissipation part of the engine, an outlet water temperature of the heat dissipation part of the engine and a water flow of the engine, a heat dissipation coefficient calibrated MAP diagram for calibrating the heat dissipation coefficient of the cooling system, a vehicle speed, a rotational speed of the fan and a rotational speed of the water pump, and a cooling system heat capacity calibrated MAP diagram for calibrating a corresponding relationship between a position of the temperature regulator and the heat capacity of the cooling system when controlling the controllable parts of the cooling system according to the performance parameters of the cooling system.

The heating power calibrated MAP diagram, the heat dissipation coefficient calibrated MAP diagram and the cooling system heat capacity calibrated MAP diagram may be obtained by calibrating the performance parameters of the cooling system before the outlet water temperatures of the engine are collected actually.

Accordingly, as shown in FIG. 7, the apparatus in this embodiment may further include a parameter calibration module 700, configured to calibrate the performance parameters of the cooling system of the engine; and the performance parameters of the cooling system include the heating power of the engine, the heat dissipation coefficient of the cooling system and the heat capacity of the cooling system.

Herein, the parameter calibration module 700 calibrates the heating power of the engine may be as follows: the rotational speed of the fan, openness of the temperature regulator, a flow of the water pump and the heat capacity of the cooling system are kept unchanged and a rotational speed and an output torque of the engine are in a constant state, an inlet water temperature, an outlet water temperature and a water flow at a water side of the heat dissipation part are detected respectively under set each rotational speed of the engine and torque of the engine; a heat generation value corresponding to the each rotational speed of the engine and torque of the engine is determined according to an association relationship among the heating power of the engine, the inlet water temperature of the heat dissipation part, the outlet water temperature of the heat dissipation part, the water flow, a specific heat capacity of the water and a density of the water; and the heating power calibrated MAP diagram for calibrating the heating power of the engine, the inlet water temperature of the heat dissipation part, the outlet water temperature of the heat dissipation part and the water flow is formed according to the determined heat generation value as well as the corresponding inlet water temperature, outlet water temperature and water flow.

Herein, in one specific application example, the association relationship among the heating power of the engine, the inlet water temperature of the heat dissipation part, the outlet water temperature of the heat dissipation part, the water flow, the specific heat capacity of the water and the density of the water may be as follows:

$$C=Q*\rho*C_p^{1}*(T_{in}-T_{out})$$

Wherein, the C is the heating power of the engine, the Q is the water flow, the ρ is the density of the water, the $C_p^{1}$ is the specific heat capacity of the water, the $T_{in}$ is the inlet water temperature of the heat dissipation part, and the $T_{out}$ is the outlet water temperature of the heat dissipation part.

the parameter calibration module 700 calibrates the heat dissipation coefficient of the cooling system may be as follows: the heating power of the engine is kept unchanged, the speed of a vehicle in which the engine is located is kept unchanged and the temperature regulator is opened fully; under the set each rotational speed of the water pump and rotational speed of the fan, the heat dissipation coefficient of the cooling system corresponding to the each rotational speed of the water pump and the rotational speed of the fan is determined according to a heat balance principle; and the rotational speed of the fan and the rotational speed of the water pump corresponding to each heat, dissipation coefficient of the cooling system are determined based on a principle that the energy consumption of the water pump and the fan is minimum, to form the heat dissipation coefficient calibrated MAP diagram for calibrating the heat dissipation coefficient of the cooling system, the vehicle speed, the rotational speed of the fan and the rotational speed of the water pump.

Herein, in one specific application example, the heat balance principle may refer to that the change differences among system water temperatures within a predetermined time period are smaller than or equal to 1° C.; and the manner for determining the heat dissipation coefficient of the cooling system corresponding to each rotational speed of the water pump and rotational, speed of the fan according to the heat balance principle may be as follows:

$$C=A(T_{water}-T_{air})$$

$$A=f(n_{fan},n_{pump},V)$$

Wherein, the C is the heating power of the engine, the A is the heat dissipation coefficient of the cooling system, the $T_{water}$ is the water temperature, the $T_{air}$ is an environmental temperature, the $n_{fan}$ is the rotational speed of the fan, the $n_{pump}$ is the rotational speed of the water pump, and the V is the vehicle speed.

The parameter calibration module 700 calibrates the heat capacity of the cooling system may be as follows: under a warming level, the temperature regulator is controlled to close a large circulation loop; in the process when the water temperature of the engine rises, the vehicle speed, the rotational speed of the water pump, the rotational speed of the fan and the heating power of the engine are kept unchanged; the heat capacity of the cooling system corresponding to each set position of the temperature regulator is measured based on a heat conservation relationship; under a cooling level, the temperature regulator is controlled to fully open the large circulation loop, and the vehicle speed, the rotational speed of the water pump, the rotational speed of the fan and the heating power of the engine are kept unchanged; the heat capacity of the cooling system corresponding to the each set position of the temperature regulator is measured based on the heat conservation relationship; and the cooling system heat capacity calibrated MAP diagram for calibrating the corresponding relationship between the position of the temperature regulator and the heat capacity of the cooling system is formed according to the heat capacity of the cooling system corresponding to the each set position of the temperature regulator under the warming level and the heat capacity of the cooling system corresponding to the each set position of the temperature regulator under the cooling level.

Herein, in one specific application example, the heat conservation relationship may be as follows:

$$C=A(T_{water}-T_{air})+C_pT_{water}$$

Wherein, the C is the heating power of the engine, the A is the heat dissipation coefficient of the cooling system, the $T_{water}$ is the water temperature, the $T_{air}$ is the environmental temperature, and the $C_p$ is the heat capacity of the cooling system.

It may be understood by those skilled in the art that other technical characteristics not mentioned in the apparatus for controlling the water temperature of the engine may be the same as the method for controlling the water temperature of the engine.

Each technical characteristic in the above embodiment may be combined freely for a simple description. All possible combinations for the each technical characteristic in the above embodiment are not described. However, the combinations of these technical characteristics should be considered as a scope of the specification In a case where there is no conflict.

The foregoing description only describes several implementation manners of the present disclosure, but is not intended to limit the protection scope of the present disclosure. It is to be noted that, any variation or replacement made by those of ordinary skill in the art without departing from the concept of the present disclosure shall fall within the protection scope of the present disclosure. Therefore, the protection scope of the present disclosure shall be subject to the claims.

What is claimed is:

1. A method for controlling a water temperature of an engine, comprising:

collecting outlet water temperatures of the engine at predetermined time intervals;

when a number of counts of the collected outlet water temperatures of the engine is greater than or equal to a predetermined number, determining a water temperature variation function of the outlet water temperatures of the engine with time according to collected each outlet water temperature of the engine and collection time corresponding to the each outlet water temperature of the engine; and determining performance parameters of a cooling system under the water temperature variation function, and controlling controllable parts of the cooling system according to the performance parameters of the cooling system.

2. The method for controlling the water temperature of the engine as claimed in claim 1, wherein determining the water temperature variation function by performing data fitting on the each outlet water temperature of the engine and the collection time corresponding to the each outlet water temperature of the engine;

before determining the performance parameters of the cooling system under the water temperature variation function, further comprising:

reading a target water temperature under a current working condition and a required time for reaching to the target water temperature, and judging whether a relationship between the target water temperature and the required time meets the water temperature variation function or not;

in a case where the relationship between the target water temperature and the required time meets the water temperature variation function, proceeding to the step of determining the performance parameters of the cooling system under the water temperature variation function; and in a case where the relationship between the target water temperature and the required time does not meet the water temperature variation function, returning to the step of determining the water temperature variation function by performing the data fitting on the each outlet water temperature of the engine and the collection time corresponding to the each outlet water temperature of the engine.

3. The method for controlling the water temperature of the engine as claimed in claim 1, wherein the performance parameters of the cooling system comprise a heating power of the engine, a heat dissipation coefficient of the cooling system and a heat capacity of the cooling system; and the controllable parts of the cooling system comprise a fan, a temperature regulator and a water pump;

controlling the controllable parts of the cooling system according to the performance parameters of the cooling system comprises:

outputting control signals for controlling the fan, the temperature regulator and the water pump respectively according to a heating power calibrated MAP diagram for calibrating the heating power of the engine, an inlet water temperature of a heat dissipation part of the engine, an outlet water temperature of the heat dissipation part of the engine and a water flow of the engine, a heat dissipation coefficient calibrated MAP diagram for calibrating a heat dissipation coefficient of the cooling system, a vehicle speed, a rotational speed of the fan and a rotational speed of the water pump, and a cooling system heat capacity calibrated MAP diagram for calibrating a corresponding relationship between a position of the temperature regulator and the heat capacity of the cooling system.

4. The method for controlling the water temperature of the engine as claimed in claim 3, before collecting the outlet water temperatures of the engine at predetermined time intervals, further comprising:

calibrating the performance parameters of the cooling system of the engine, the performance parameters of the cooling system comprise the heating power of the engine, the heat dissipation coefficient of the cooling system and the heat capacity of the cooling system;

calibrating the heating power of the engine comprises: keeping the rotational speed of the fan, openness of the temperature regulator, a flow of the water pump and the heat capacity of the cooling system unchanged and a rotational speed and an output torque of the engine in a constant state, respectively detecting an inlet water temperature, an outlet water temperature and a water flow at a water side of the heat dissipation part under set each rotational speed of the engine and torque of the engine, determining a heat generation value corresponding to the each rotational speed of the engine and torque of the engine according to an association relationship among the heating power of the engine, the inlet water temperature of the heat dissipation part, the outlet water temperature of the heat dissipation part, the water flow, a specific heat capacity of the water and a density of the water, and forming the heating power calibrated MAP diagram for calibrating the heating power of the engine, the inlet water temperature of the heat dissipation part, the outlet water temperature of the heat dissipation part and the water flow according to the determined heat generation value as well as the corresponding inlet water temperature, outlet water temperature and water flow;

calibrating the heat dissipation coefficient of the cooling system comprises: keeping the heating power of the engine unchanged, the speed of a vehicle in which the engine is located unchanged and the temperature regulator opened fully; under set each rotational speed of the water pump and rotational speed of the fan, determining the heat dissipation coefficient of the cooling system corresponding to the each rotational speed of the water pump and rotational speed of the fan according to a heat balance principle, and determining the rotational speed of the fan and the rotational speed of the water pump corresponding to each heat dissipation coefficient of the cooling system based on a principle that the energy consumption of the water pump and the fan is minimum, to form the heat dissipation coefficient calibrated MAP diagram for calibrating the heat dissipation coefficient of the cooling system, the vehicle speed, the rotational speed of the fan and the rotational speed of the water pump; and calibrating the heat capacity of the cooling system comprises: under a warming level, controlling the temperature regulator to close a large circulation loop; in the process when the water temperature of the engine rises, keeping the vehicle speed, the rotational speed of the water pump, the rotational speed of the fan and the heating power of the engine unchanged; measuring the heat capacity of the cooling system corresponding to each set position of the temperature regulator based on a heat conservation relationship; under a cooling level, controlling the temperature regulator to fully open the large circulation loop, and keeping the vehicle speed, the rotational speed of the water pump, the rotational speed of the fan and the heating power of the engine unchanged; measuring the heat capacity of the cooling system corresponding to the each set position of the temperature regulator based on the heat conservation relationship; and forming the cooling system heat capacity calibrated MAP diagram for calibrating the corresponding relationship between the position of the temperature regulator and the heat capacity of the cooling system according to the heat capacity of the cooling system corresponding to the each set position of the temperature regulator under the warming level and the heat capacity of the cooling system corresponding to the each set position of the temperature regulator under the cooling level.

5. The method for controlling the water temperature of the engine as claimed in claim 4, comprising at least one of the followings:

the association relationship among the heating power of the engine, the inlet water temperature of the heat dissipation part, the outlet water temperature of the heat dissipation part, the water flow, the specific heat capacity of the water and the density of the water comprises:

$$C=Q*\rho*C_p^{1}*(T_{in}-T_{out}),$$

wherein the C is the heating power of the engine, the Q is the water flow, the ρ is the density of the water, the $C_p^1$ is the specific heat capacity of the water, the $T_{in}$ is the inlet water temperature of the heat dissipation part, and the $T_{out}$ is the outlet water temperature of the heat dissipation part;

the heat balance principle comprises: change differences among system water temperatures within a predetermined time period are smaller than or equal to 1° C.; determining the heat dissipation coefficient of the cooling system corresponding to each rotational speed of the water pump and rotational speed of the fan according to the heat balance principle comprises:

$$C=A(T_{water}-T_{air}),\ \text{wherein}\ A=f(n_{fan},n_{pump},V),$$

the C is the heating power of the engine, the A is the heat dissipation coefficient of the cooling system, the $T_{water}$ is the water temperature, the $T_{air}$ is an environmental temperature, the $n_{fan}$ is the rotational speed of the fan, the $n_{pump}$ is the rotational speed of the water pump, and the V is the vehicle speed;

the heat conservation relationship is as follows:

$$C=A(T_{water}-T_{air})+C_pT_{water},$$

wherein the C is the heating power of the engine, the A is the heat dissipation coefficient of the cooling system, the $T_{water}$ is the water temperature, the $T_{air}$ is the environmental temperature, and the $C_p$ is the heat capacity of the cooling system.

6. The method for controlling the water temperature of the engine as claimed in claim 2, wherein the performance parameters of the cooling system comprise a heating power of the engine, a heat dissipation coefficient of the cooling system and a heat capacity of the cooling system; and the controllable parts of the cooling system comprise a fan, a temperature regulator and a water pump;

controlling the controllable parts of the cooling system according to the performance parameters of the cooling system comprises:

outputting control signals for controlling the fan, the temperature regulator and the water pump respectively according to a heating power calibrated MAP diagram for calibrating the heating power of the engine, an inlet water temperature of a heat dissipation part of the engine, an outlet water temperature of the heat dissipation part of the engine and a water flow of the engine, a heat dissipation coefficient calibrated MAP diagram for calibrating a heat dissipation coefficient of the cooling system, a vehicle speed, a rotational speed of the fan and a rotational speed of the water pump, and a cooling system heat capacity calibrated MAP diagram for calibrating a corresponding relationship between a position of the temperature regulator and the heat capacity of the cooling system.

7. The method for controlling the water temperature of the engine as claimed in claim 6, before collecting the outlet water temperatures of the engine at predetermined time intervals, further comprising:

calibrating the performance parameters of the cooling system of the engine, the performance parameters of the cooling system comprise the heating power of the engine, the heat dissipation coefficient of the cooling system and the heat capacity of the cooling system;

calibrating the heating power of the engine comprises: keeping the rotational speed of the fan, openness of the temperature regulator, a flow of the water pump and the heat capacity of the cooling system unchanged and a rotational speed and an output torque of the engine in a constant state, respectively detecting an inlet water temperature, an outlet water temperature and a water flow at a water side of the heat dissipation part under set each rotational speed of the engine and torque of the engine, determining a heat generation value corresponding to the each rotational speed of the engine and torque of the engine according to an association relationship among the heating power of the engine, the inlet water temperature of the heat dissipation part, the outlet water temperature of the heat dissipation part, the water flow, a specific heat capacity of the water and a density of the water, and forming the heating power calibrated MAP diagram for calibrating the heating power of the engine, the inlet water temperature of the heat dissipation part, the outlet water temperature of the heat dissipation part and the water flow according to the determined heat generation value as well as the corresponding inlet water temperature, outlet water temperature and water flow;

calibrating the heat dissipation coefficient of the cooling system comprises: keeping the heating power of the engine unchanged, the speed of a vehicle in which the engine is located unchanged and the temperature regulator opened fully; under set each rotational speed of the water pump and rotational speed of the fan, determining the heat dissipation coefficient of the cooling system corresponding to the each rotational speed of the water pump and rotational speed of the fan according to a heat balance principle, and determining the rotational speed of the fan and the rotational speed of the water pump corresponding to each heat dissipation coefficient of the cooling system based on a principle that the energy consumption of the water pump and the fan is minimum, to form the heat dissipation coefficient calibrated MAP diagram for calibrating the heat dissipation coefficient of the cooling system, the vehicle speed, the rotational speed of the fan and the rotational speed of the water pump; and calibrating the heat capacity of the cooling system comprises: under a warming level, controlling the temperature regulator to close a large circulation loop; in the process when the water temperature of the engine rises, keeping the vehicle speed, the rotational speed of the water pump, the rotational speed of the fan and the heating power of the engine unchanged; measuring the heat capacity of the cooling system corresponding to each set position of the temperature regulator based on a heat conservation relationship; under a cooling level, controlling the temperature regulator to fully open the large circulation loop, and keeping the vehicle speed, the rotational speed of the water pump, the rotational speed of the fan and the heating power of the engine unchanged; measuring the heat capacity of the cooling system corresponding to the each set position of the temperature regulator based on the heat conservation relationship; and forming the cooling system heat capacity calibrated MAP diagram for calibrating the corresponding relationship between the position of the temperature regulator and the heat capacity of the cooling system according to the heat capacity of the cooling system corresponding to the each set position of the temperature regulator under the warming level and the heat capacity of the cooling system corresponding to the each set position of the temperature regulator under the cooling level.

8. The method for controlling the water temperature of the engine as claimed in claim 7, comprising at least one of the followings:

the association relationship among the heating power of the engine, the inlet water temperature of the heat dissipation part, the outlet water temperature of the heat dissipation part, the water flow, the specific heat capacity of the water and the density of the water comprises:

$$C=Q*\rho*C_p^{1}*(T_{in}-T_{out}),$$

wherein the C is the heating power of the engine, the Q is the water flow, the ρ is the density of the water, the $C_p^1$ is the specific heat capacity of the water, the $T_{in}$ is the inlet water temperature of the heat dissipation part, and the $T_{out}$ is the outlet water temperature of the heat dissipation part;

the heat balance principle comprises: change differences among system water temperatures within a predetermined time period are smaller than or equal to 1° C.; determining the heat dissipation coefficient of the cooling system corresponding to each rotational speed of the water pump and rotational speed of the fan according to the heat balance principle comprises:

$$C=A(T_{water}-T_{air}),\ \text{wherein}\ A=f(n_{fan},n_{pump},V),$$

the C is the heating power of the engine, the A is the heat dissipation coefficient of the cooling system, the $T_{water}$ is the water temperature, the $T_{air}$ is an environmental temperature, the $n_{fan}$ is the rotational speed of the fan, the $n_{pump}$ is the rotational speed of the water pump, and the V is the vehicle speed;

the heat conservation relationship is as follows:

$$C=A(T_{water}-T_{air})+C_pT_{water},$$

wherein the C is the heating power of the engine, the A is the heat dissipation coefficient of the cooling system, the $T_{water}$ is the water temperature, the $T_{air}$ is the environmental temperature, and the $C_p$ is the heat capacity of the cooling system.

9. An apparatus for controlling a water temperature of an engine, comprising:

a temperature collection module, configured to collect outlet water temperatures of the engine at predetermined time intervals;

a water temperature function determination module, configured to determine, when a number of counts of the collected outlet water temperatures of the engine is greater than or equal to a predetermined number are collected, a water temperature variation function of the outlet water temperatures of the engine with time according to collected each outlet water temperature of the engine and collection time corresponding to the each outlet water temperature of the engine;

a performance parameter determination module, configured to determine performance parameters of a cooling system under the water temperature variation function; and a control module, configured to control controllable parts of the cooling system according to the performance parameters of the cooling system.

10. The apparatus for controlling the water temperature of the engine as claimed in claim 9, further comprising a consistency judgment module, wherein the consistency judgment module is configured to read a target water temperature under a current working condition and a required time for reaching to the target water temperature, and judge whether a relationship between the target water temperature and the required time meets the water temperature variation function or not;

the water temperature function determination module determines the water temperature variation function by performing data fitting on the collected each outlet water temperature of the engine and the collection time corresponding to the each outlet water temperature of the engine, and when a judgment result of the consistency judgment module is no, determine the water temperature variation function by using the manner for performing the data fitting on the collected each outlet water temperature of the engine and the collection time corresponding to the each outlet water temperature of the engine again; and the performance parameter determination module determines the performance parameters of the cooling system under the water temperature variation function when the judgment result of the consistency judgment module is yes.

11. The apparatus for controlling the water temperature of the engine as claimed in claim 9, wherein the performance parameters of the cooling system comprise a heating power of the engine, a heat dissipation coefficient of the cooling system and a heat capacity of the cooling system; the controllable parts of the cooling system comprise a fan, a temperature regulator and a water pump;

the control module respectively outputs control signals for controlling the fan, the temperature regulator and the water pump according to a heating power calibrated MAP diagram for calibrating the heating power of the engine, an inlet water temperature of a heat dissipation part of the engine, an outlet water temperature of the heat dissipation part of the engine and a water flow of the engine, a heat dissipation coefficient calibrated MAP diagram for calibrating the heat dissipation coefficient of the cooling system, a vehicle speed, a rotational speed of the fan and a rotational speed of the water pump, and a cooling system heat capacity calibrated MAP diagram for calibrating a corresponding relationship between a position of the temperature regulator and the heat capacity of the cooling system when controlling the controllable parts of the cooling system according to the performance parameters of the cooling system.

12. The apparatus for controlling the water temperature of the engine as claimed in claim 11, further comprising a parameter calibration module, configured to calibrate the performance parameters of the cooling system of the engine, wherein the performance parameters of the cooling system comprise the heating power of the engine, the heat dissipation coefficient of the cooling system and the heat capacity of the cooling system;

the parameter calibration module calibrates the heating power of the engine comprises: the rotational speed of the fan, openness of the temperature regulator, a flow of the water pump and the heat capacity of the cooling system are kept unchanged and a rotational speed and an output torque of the engine are in a constant state, an inlet water temperature, an outlet water temperature and a water flow at a water side of the heat dissipation part are detected respectively under set each rotational speed of the engine and torque of the engine; a heat generation value corresponding to the each rotational speed of the engine and torque of the engine is determined according to an association relationship among the heating power of the engine, the inlet water temperature of the heat dissipation part, the outlet water temperature of the heat dissipation part, the water flow, a specific heat capacity of the water and a density of the water; and the heating power calibrated MAP diagram for calibrating the heating power of the engine, the inlet water temperature of the heat dissipation part, the outlet water temperature of the heat dissipation part and the water flow is formed according to the determined heat generation value as well as the corresponding inlet water temperature, outlet water temperature and water flow;

the parameter calibration module calibrates the heat dissipation coefficient of the cooling system comprises: the heating power of the engine is kept unchanged, the speed of a vehicle in which the engine is located is kept unchanged and the temperature regulator is opened fully; under the set each rotational speed of the water pump and rotational speed of the fan, the heat dissipation coefficient of the cooling system corresponding to each rotational speed of the water pump and the rotational speed of the fan is determined according to a heat balance principle; and the rotational speed of the fan and the rotational speed of the water pump corresponding to each heat dissipation coefficient of the cooling system are determined based on a principle that the energy consumption of the water pump and the fan is minimum, to form the heat dissipation coefficient calibrated MAP diagram for calibrating the heat dissipation coefficient of the cooling system, the vehicle speed, the rotational speed of the fan and the rotational speed of the water pump; and the parameter calibration module calibrates the heat capacity of the cooling system may be as follows: under a warming level, the temperature regulator is controlled to close a large circulation loop; in the process when the water temperature of the engine rises, the vehicle speed, the rotational speed of the water pump, the rotational speed of the fan and the heating power of the engine are kept unchanged; the heat capacity of the cooling system corresponding to each set position of the temperature regulator is measured based on a heat conservation relationship; under a cooling level, the temperature regulator is controlled to fully open the large circulation loop, and the vehicle speed, the rotational speed of the water pump, the rotational speed of the fan and the heating power of the engine are kept unchanged; the heat capacity of the cooling system corresponding to the each set position of the temperature regulator is measured based on the heat conservation relationship; and the cooling system heat capacity calibrated MAP diagram for calibrating the corresponding relationship between the position of the temperature regulator and the heat capacity of the cooling system is formed according to the heat capacity of the cooling system corresponding to the each set position of the temperature regulator under the warming level and the heat capacity of the cooling system corresponding to the each set position of the temperature regulator under the cooling level.

13. The apparatus for controlling the water temperature of the engine as claimed in claim 12, comprising at least one of the followings:

the association relationship among the heating power of the engine, the inlet water temperature of the heat dissipation part, the outlet water temperature of the heat dissipation part, the water flow, the specific heat capacity of the water and the density of the water comprises:

$$C=Q*\rho*C_p^1*(T_{in}-T_{out}),$$

wherein the C is the heating power of the engine, the Q is the water flow, the ρ is the density of the water, the $C_p^1$ is the specific heat capacity of the water, the $T_{in}$ is the inlet water temperature of the heat dissipation part, and the $T_{out}$ is the outlet water temperature of the heat dissipation part;

the heat balance principle comprises: change differences among system water temperatures within a predetermined time period are smaller than or equal to 1° C.; determining the heat dissipation coefficient of the cooling system corresponding to each rotational speed of the water pump and rotational speed of the fan according to the heat balance principle comprises:

$$C=A(T_{water}-T_{air}), \text{ wherein } A=f(n_{fan},n_{pump},V),$$

the C is the heating power of the engine, the A is the heat dissipation coefficient of the cooling system, the $T_{water}$ is the water temperature, the $T_{air}$ is an environmental temperature, the $n_{fan}$ is the rotational speed of the fan, the $n_{pump}$ is the rotational speed of the water pump, and the V is the vehicle speed;

the heat conservation relationship is as follows:

$$C=A(T_{water}-T_{air})+C_pT_{water},$$

wherein the C is the heating power of the engine, the A is the heat dissipation coefficient of the cooling system, the $T_{water}$ is the water temperature, the $T_{air}$ is the environmental temperature, and the $C_p$ is the heat capacity of the cooling system.

14. The apparatus for controlling the water temperature of the engine as claimed in claim 10, wherein the performance parameters of the cooling system comprise a heating power of the engine, a heat dissipation coefficient of the cooling system and a heat capacity of the cooling system; the controllable parts of the cooling system comprise a fan, a temperature regulator and a water pump;

the control module respectively outputs control signals for controlling the fan, the temperature regulator and the water pump according to a heating power calibrated MAP diagram for calibrating the heating power of the engine, an inlet water temperature of a heat dissipation part of the engine, an outlet water temperature of the heat dissipation part of the engine and a water flow of the engine, a heat dissipation coefficient calibrated MAP diagram for calibrating the heat dissipation coefficient of the cooling system, a vehicle speed, a rotational speed of the fan and a rotational speed of the water pump, and a cooling system heat capacity calibrated MAP diagram for calibrating a corresponding relationship between a position of the temperature regulator and the heat capacity of the cooling system when controlling the controllable parts of the cooling system according to the performance parameters of the cooling system.

15. The apparatus for controlling the water temperature of the engine as claimed in claim 14, further comprising a parameter calibration module, configured to calibrate the performance parameters of the cooling system of the engine, wherein the performance parameters of the cooling system comprise the heating power of the engine, the heat dissipation coefficient of the cooling system and the heat capacity of the cooling system;

the parameter calibration module calibrates the heating power of the engine comprises: the rotational speed of the fan, openness of the temperature regulator, a flow of the water pump and the heat capacity of the cooling system are kept unchanged and a rotational speed and an output torque of the engine are in a constant state, an inlet water temperature, an outlet water temperature and a water flow at a water side of the heat dissipation part are detected respectively under set each rotational speed of the engine and torque of the engine; a heat generation value corresponding to the each rotational speed of the engine and torque of the engine is determined according to an association relationship among the heating power of the engine, the inlet water temperature of the heat dissipation part, the outlet water temperature of the heat dissipation part, the water flow, a specific heat capacity of the water and a density of the water; and the heating power calibrated MAP diagram for calibrating the heating power of the engine, the inlet water temperature of the heat dissipation part, the outlet water temperature of the heat dissipation part and the water flow is formed according to the determined heat generation value as well as the corresponding inlet water temperature, outlet water temperature and water flow;

the parameter calibration module calibrates the heat dissipation coefficient of the cooling system comprises: the heating power of the engine is kept unchanged, the speed of a vehicle in which the engine is located is kept unchanged and the temperature regulator is opened fully; under the set each rotational speed of the water pump and rotational speed of the fan, the heat dissipation coefficient of the cooling system corresponding to each rotational speed of the water pump and the rotational speed of the fan is determined according to a heat balance principle; and the rotational speed of the fan and the rotational speed of the water pump corresponding to each heat dissipation coefficient of the cooling system are determined based on a principle that the energy consumption of the water pump and the fan is minimum, to form the heat dissipation coefficient calibrated MAP diagram for calibrating the heat dissipation coefficient of the cooling system, the vehicle speed, the rotational speed of the fan and the rotational speed of the water pump; and the parameter calibration module calibrates the heat capacity of the cooling system may be as follows: under a warming level, the temperature regulator is controlled to close a large circulation loop; in the process when the water temperature of the engine rises, the vehicle speed, the rotational speed of the water pump, the rotational speed of the fan and the heating power of the engine are kept unchanged; the heat capacity of the cooling system corresponding to each set position of the temperature regulator is measured based on a heat conservation relationship; under a cooling level, the temperature regulator is controlled to fully open the large circulation loop, and the vehicle speed, the rotational speed of the water pump, the rotational speed of the fan and the heating power of the engine are kept unchanged; the heat capacity of the cooling system corresponding to the each set position of the temperature regulator is measured based on the heat conservation relationship; and the cooling system heat capacity calibrated MAP diagram for calibrating the corresponding relationship between the position of the temperature regulator and the heat capacity of the cooling system is formed according to the heat capacity of the cooling system corresponding to the each set position of the temperature regulator under the warming level and the heat capacity of the cooling system corresponding to the each set position of the temperature regulator under the cooling level.

16. The apparatus for controlling the water temperature of the engine as claimed in claim 15, comprising at least one of the followings:

the association relationship among the heating power of the engine, the inlet water temperature of the heat dissipation part, the outlet water temperature of the heat dissipation part, the water flow, the specific heat capacity of the water and the density of the water comprises:

$$C=Q*\rho*C_p^1*(T_{in}-T_{out}),$$

wherein the C is the heating power of the engine, the Q is the water flow, the ρ is the density of the water, the $C_p^1$ is the specific heat capacity of the water, the $T_{in}$ is the inlet water temperature of the heat dissipation part, and the $T_{out}$ is the outlet water temperature of the heat dissipation part;

the heat balance principle comprises: change differences among system water temperatures within a predetermined time period are smaller than or equal to 1° C.; determining the heat dissipation coefficient of the cooling system corresponding to each rotational speed of the water pump and rotational speed of the fan according to the heat balance principle comprises:

$$C=A(T_{water}-T_{air}),\ \text{wherein}\ A=f(n_{fan},n_{pump},V),$$

the C is the heating power of the engine, the A is the heat dissipation coefficient of the cooling system, the $T_{water}$ is the water temperature, the $T_{air}$ is an environmental temperature, the $n_{fan}$ is the rotational speed of the fan, the $n_{pump}$ is the rotational speed of the water pump, and the V is the vehicle speed;

the heat conservation relationship is as follows:

$$C=A(T_{water}-T_{air})+C_pT_{water},$$

wherein the C is the heating power of the engine, the A is the heat dissipation coefficient of the cooling system, the $T_{water}$ is the water temperature, the $T_{air}$ is the environmental temperature, and the $C_p$ is the heat capacity of the cooling system.

* * * * *